US005211349A

United States Patent [19]

Sinar

[11] Patent Number: 5,211,349

[45] Date of Patent: May 18, 1993

[54] SLEEVE AND REEL FOR WINDING STRIP INTO COIL

[75] Inventor: Michael M. Sinar, Porter County, Ind.

[73] Assignee: USX Corporation, Pittsburgh, Pa.

[21] Appl. No.: 757,417

[22] Filed: Sep. 10, 1991

[51] Int. Cl.[5] ..... B65H 18/08; B65H 75/24

[52] U.S. Cl. ..... 242/72 R; 242/68.5; 242/78.1

[58] Field of Search ..... 242/72.1, 72 R, 68.5, 242/78.1

[56] References Cited

U.S. PATENT DOCUMENTS

| | | | |
|---|---|---|---|
| 2,941,745 | 6/1960 | Perrine | 242/72.1 |
| 3,116,891 | 1/1964 | Anderson et al. | 242/72.1 |
| 3,379,389 | 4/1968 | O'Keefe | 242/72.1 |
| 3,396,918 | 8/1968 | Adamson et al. | 242/72 R |
| 3,593,938 | 7/1971 | Watt | 242/72 R |
| 4,078,739 | 3/1978 | Noe | 242/72.1 |
| 4,695,008 | 9/1987 | Dabrowski | 242/68.5 |
| 4,697,757 | 10/1987 | Nakaya et al. | 242/68.5 |
| 4,802,637 | 2/1989 | Williams | 242/72 R |
| 4,832,276 | 5/1989 | Gebhardt et al. | 242/78.1 |

*Primary Examiner*—Stanley N. Gilreath
*Attorney, Agent, or Firm*—W. F. Riesmeyer, III

[57] ABSTRACT

An elastomeric sleeve adapted to be mounted on a reel for winding strip into coil form has metal inserts adjacent a gripper slot opening for preventing flat spots in the coil. The sleeve is designed to permit sufficient expansion when the reel is expanded so that the gripper opening is not pulled apart and a widened gap is not formed therebetween. Preferably, slits are provided on the inner periphery of the sleeve for this purpose. Alternatively, a collar can be mounted on the outboard end of the segment bridging the gripper opening for enhanced structural rigidity to prevent the sleeve from pulling apart the gripper opening upon expansion of the reel.

6 Claims, 4 Drawing Sheets

SLEEVE AND REEL FOR WINDING STRIP INTO COIL

BACKGROUND OF THE INVENTION

The present invention relates to a sleeve for installation on a reel used to wind metal strip into coil form, and particularly to an elastomeric sleeve having metal inserts adapted to lie adjacent to a gripper opening of the reel to prevent flat spots and creases from occurring in the strip over the gripper opening as the strip is wound into coil form on the reel.

In the production of steel strip in coil form, the strip is commonly wound onto a segmented reel that can be expanded and contracted to permit alternate winding of the strip into coil form and removal of the wound coil from the reel. When segmented reels are used, having a gripper segment for receiving an end of the strip, flat spots and creases often occur in the first few wraps of the coil at the location of the gripper segment. The flat spots and creases are more prominent on relatively thin gage strip and are especially undesirable on strip for automotive applications.

U.S. Pat. No. 4,832,276, Gebhardt, et al. discloses a one piece cylindrical sleeve of compressible material for preventing creases in metal strip wound into coil form on a reel. The sleeve has a thin easily compressible outer elastomeric sleeve bonded to a thicker, harder more rigid inner sleeve. The dual hardness compound sleeve generally prevents creases yet retains its shape for easy removal of a coil wound on the reel. However, when the end of the strip has a substantial burr due to use of a dull shear blade, creases still occur when the strip is wrapped over the strip end having the burr thereon. Applicant's invention eliminates this problem because the end of the strip is hidden within the gripper slot. The reference sleeve does not have a longitudinal opening mateable with a gripper segment opening of the reel. The sleeve of Applicant's invention has such a longitudinal opening with metal inserts embedded in the sleeve at the longitudinal edges forming the opening therein. Another disadvantage of the reference sleeve is that a belt wrapper must be used to guide the strip as it is wound onto the sleeve. Use of a belt wrapper is not required with Applicant's invention.

It is known to provide a reel having a gripper segment opening with a plurality of metal adaptor segments each having elastomeric material bonded to the metal segments. The adaptor segments are attached to the reel in order to increase the diameter of the reel for winding coils having a larger inside diameter. The adaptor segments do not have metal inserts embedded in the elastomeric material so as to form a rigid surface at the opposed outer edges of the sleeve adjoining the ripper segment opening as in Applicant's invention.

SUMMARY OF THE INVENTION

According to this invention, a sleeve is provided for installation on to an expandable and collapsible segmented reel having a gripper opening for securing one end of a metal strip therein. The sleeve is a cylindrically-shaped piece of flexible elastomeric material adapted to be wrapped around the outer periphery of the reel. The sleeve has opposed ends having edges extending longitudinally to form an axial opening therein. The edges of the ends of the sleeve fit mateably with opposed edges of the gripper opening of the reel. The opposed ends of the sleeve have means for providing sufficient stiffness in the sleeve adjacent the gripper opening so as to minimize a flat spot in a coil of metal strip wound on to the reel. Means are also provided on an inner surface of the sleeve abutting the outer periphery of the reel for permitting sufficient expansion of the flexible elastomeric material so that the gripper opening is not pulled apart and a widened gap is not formed upon expansion of the reel, thus decreasing the probability of forming flat spots in the coil.

In another aspect, the invention is of a segmented reel having a sleeve with means for providing sufficient stiffness in the sleeve adjacent the gripper opening to minimize a flat spot in a coil of metal wound on to the reel. The reel also includes means for preventing the sleeve from pulling apart the gripper opening and forming a widened gap therein upon expansion of the reel.

DESCRIPTION OF THE PREFERRED EMBODIMENT

Figure 1:
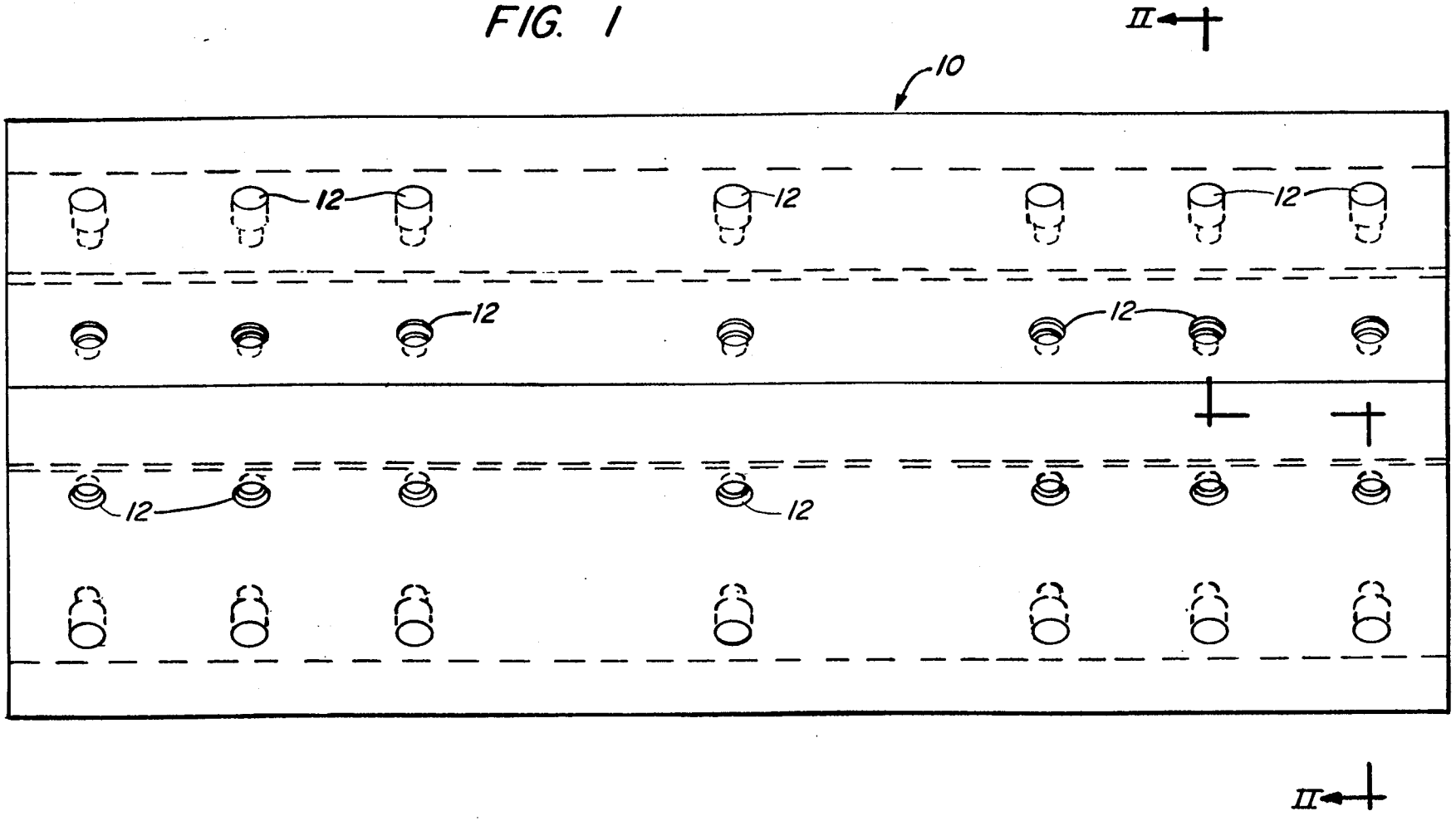
FIG. 1 is side elevation view of the sleeve portion of the present invention.
Figure 2:
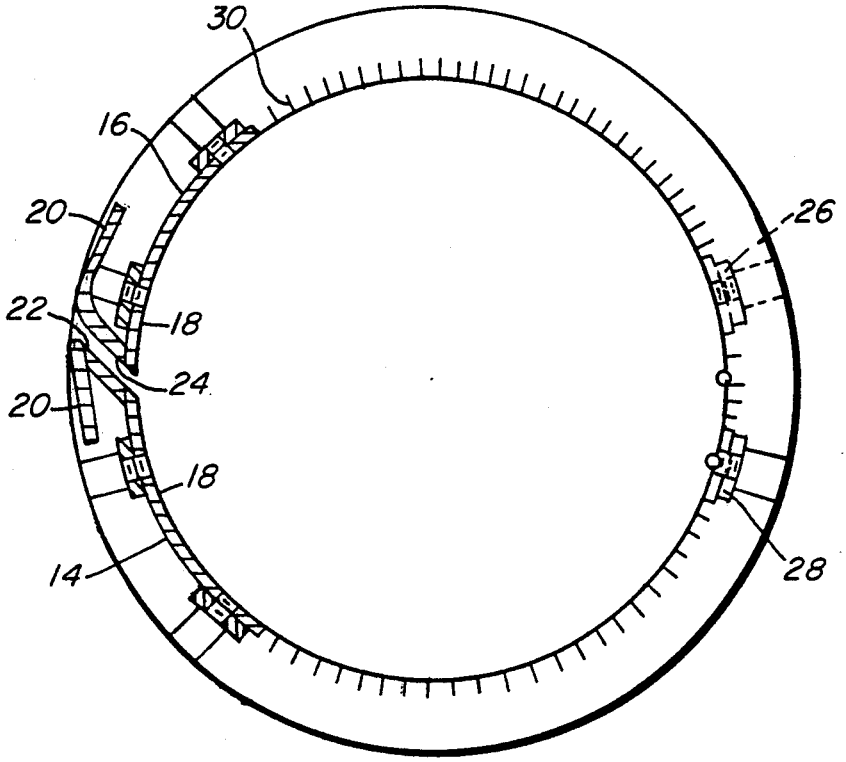
FIG. 2 is a section taken at II—II of FIG. 1.
Figure 3:
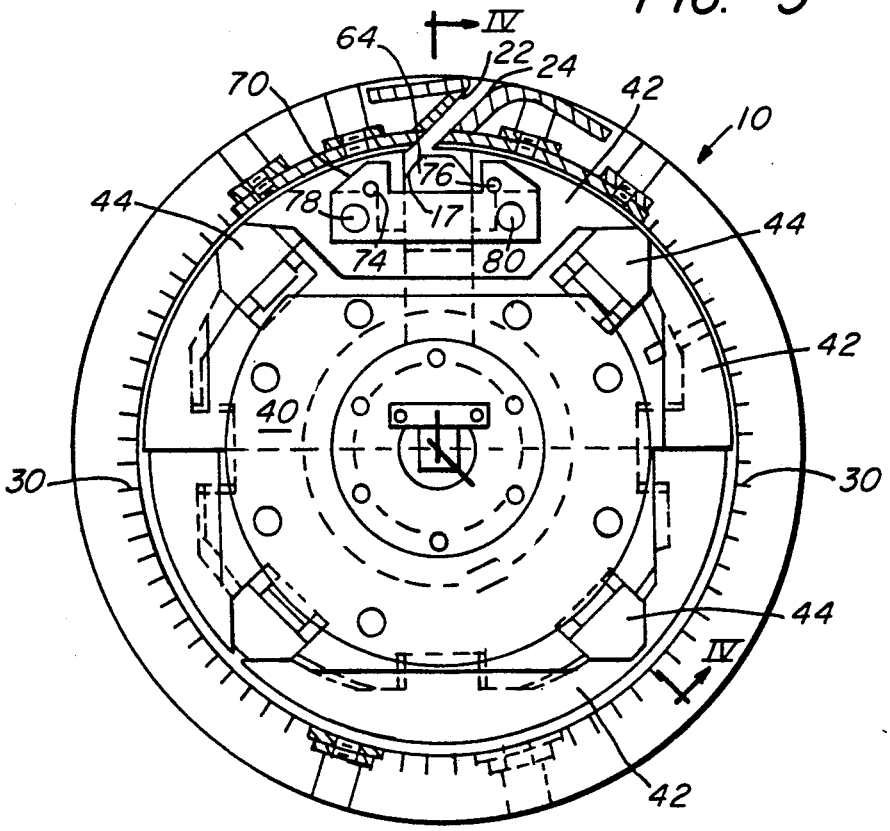
FIG. 3 is an end view of a segmented expandable and collapsible reel showing the present sleeve and collar of the invention.

FIG. 1 shows the flexible elastomeric sleeve 10 portion of the present invention. The sleeve is cylindrically shaped and adapted to fit around the outer periphery of a segmented expandable and collapsable reel for winding a coil of metal strip thereon. The sleeve has a plurality of holes 12 therethrough for receipt of shoulder bolts to attach the sleeve to the outer periphery of the reel as described below. Referring to FIG. 2, sleeve 10 has metal inserts 14 and 16 embedded therein. The metal inserts provide sufficient stiffness in the sleeve to support the strip wound onto the reel so as to prevent the formation of a flat spot at the area over the gripper opening 17 (FIG. 3). The elastomeric material is bonded to the inserts so as to make the sleeve an integral unit. Each insert has a surface forming the inner and outer surfaces 18 and 20 and edge faces 22 and 24 of the sleeve at the ends adjacent to the gripper opening of the reel. Metal rings 26 and 28 are embedded in the sleeve to provide support for shoulder bolts at locations opposite metal inserts 14 and 16. Preferably, the sleeve is about two inches thick and of polyurethane material having a hardness of about 80 Durometer on the A scale. The metal inserts are of conventional A-36 carbon steel. A plurality of slits 30 are provided on the surface of the inner periphery of the sleeve. The slits permit sufficient expansion of the flexible elastomeric material when the segmented reel is moved from a collapsed to an expanded position that the gripper opening is not pulled apart and a widened gap is not formed therebetween. Preferably, the slits are about 1/8 inch wide, about ¾ inch deep and spaced about ¾ inches apart on the inner periphery.

Referring to FIG. 3, sleeve 10 is shown in position on a segmented expandable and collapsible reel 40 having a gripper opening 17 for securing an end of strip (not shown) to be wound onto the sleeve on the reel. The reel is of conventional type and includes a plurality of expandable segments 42 separated by filler blocks 44. The upper half of FIG. 3 shows the segments and filler blocks extended so that the reel is expanded; whereas, in the lower half of FIG. 3, they are retracted showing the reel in collapsed position. The sleeve is positioned so that the edge faces 22 and 24 are mateably aligned with the gripper opening when the segments and filler blocks are retracted to the fully open position. Edge 22 remains mateably aligned with the gripper opening when the segments and filler blocks are extended to the closed position for securing one end of the metal strip therein.

Figure 4:
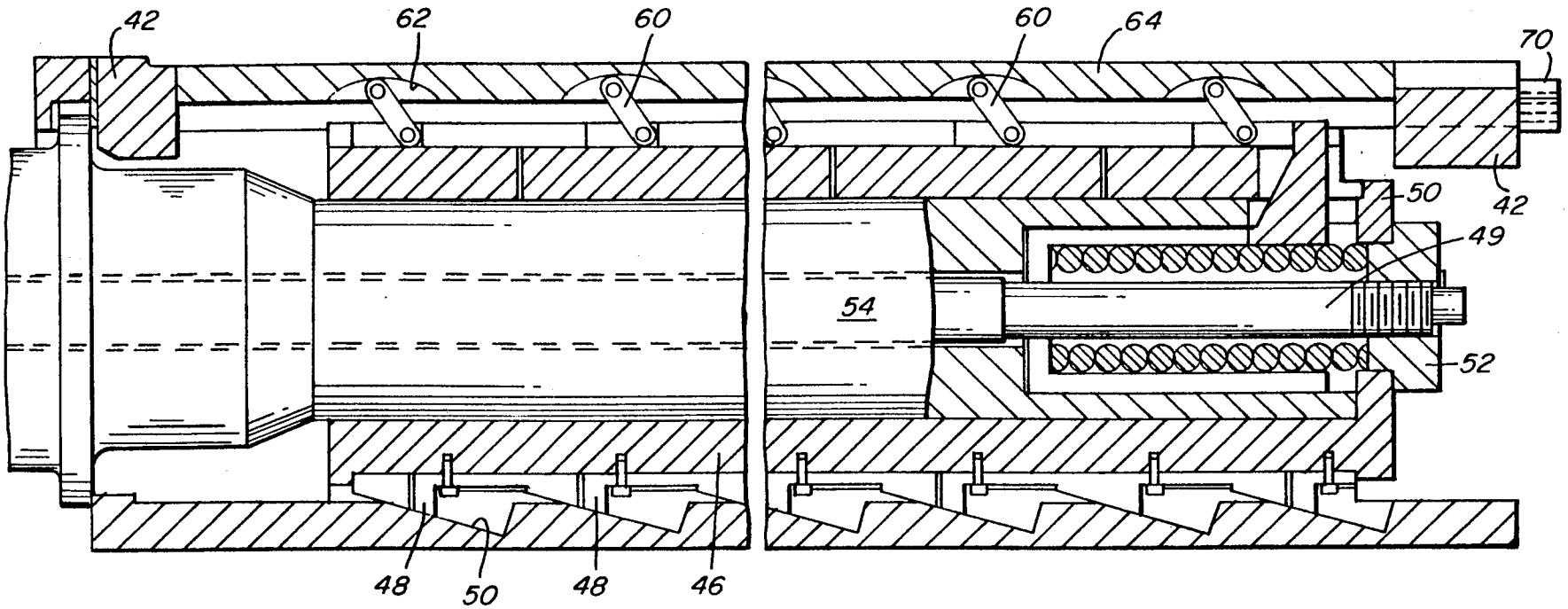
FIG. 4 is a section taken at IV—IV of FIG. 3.

Referring to FIG. 4, spreader bar 46 has a plurality of wedge-shaped protrusions 48 slidably engaged in mateably shaped slots 50 of each filler block. The spreader bar has similar wedge-shaped protrusions (not shown) slidably engaged in mateably shaped slots (not shown) of each segment. The spreader bar also has a plurality of pivotal bearing arms 60 adapted for pivotal movement in recesses 62 of gripper bar 64. Spreader bar 46 is secured to reciprocable pull rod 49 by end plate 50 and nut 52. Spreader bar 46 is slidably mounted on mandrel 54. Reciprocation of pull rod 49 back and forth in the axial direction by cylinder means (not shown) causes alternate expansion and retraction of the segments, filler blocks and gripper bar so that the reel moves alternately to expanded and collapsed positions, respectively.

Figure 6:
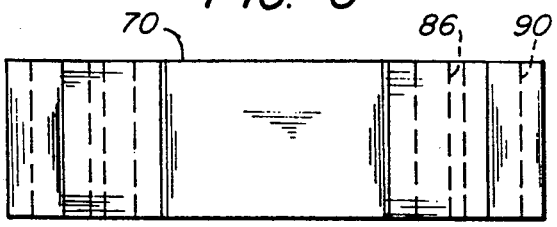
FIG. 6 is a plan view of the collar shown in FIG. 5.
Figure 5:
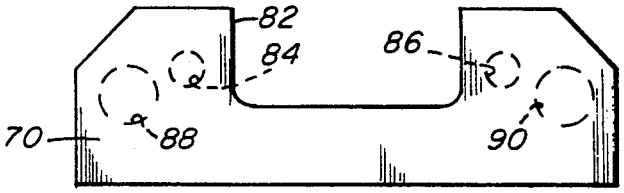
FIG. 5 is a side elevation view of the collar for support of the outbound end of the segment for the gripper opening of the reel.
Figure 7:
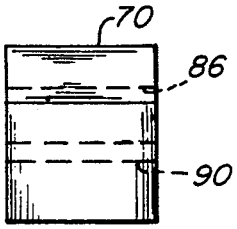
FIG. 7 is an end view of the collar shown in FIG. 5.

Sleeve 10 is installed on the reel when the reel is in the collapsed position. A collar 70 (FIGS. 3 and 4) is secured to the outboard end of the segment which houses gripper bar 64. Collar 70 is secured to the segment by a pair of cap screws 74 and 76. Dowel pins 78 and 80 are provided for strengthening the attachment of collar 70 to the segment. Collar 70 provides structural support for the segment housing the gripper bar and prevents the sleeve from pulling apart the opening between the gripper bar and the segment 42 particularly, the outboard end thereof. Collar 70 shown in enlarged detail in FIGS. 5, 6 and 7 has a slot 82 for permitting the end of the strip located in the gripper opening to pass through when a coil is removed from the reel. A pair of holes 84 and 86 are provided for receipt of the cap screws therein. A pair of holes 88 and 90 are provided for the dowel pins to mount the collar on the gripper segment.

Figure 9:
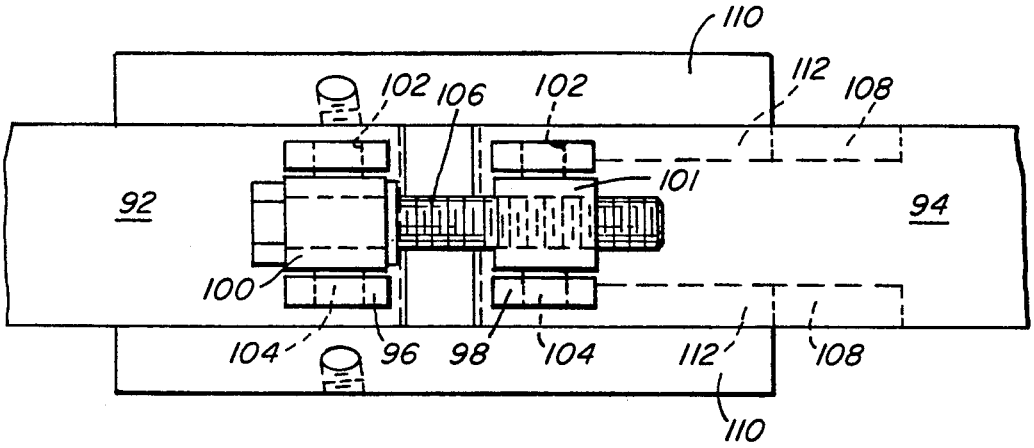
FIG. 9 is a plan view of the lifting strap of FIG. 8.
Figure 8:
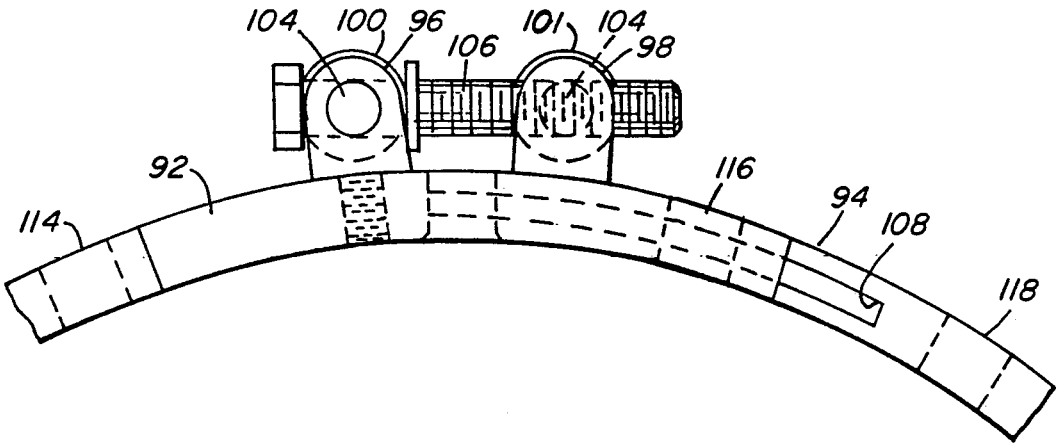
FIG. 8 is a side elevation view of a lifting strap for installation of the sleeve on the reel.

To install the sleeve on the reel, I move the reel to the collapsed position. Then, I install a boot lifting strap as shown in FIGS. 8 and 9. The lifting strap includes two arc plates 92 and 94 shaped to fit on the outer periphery of the sleeve. Each plate has a pair of brackets 96 and 98 secured to an outer surface thereof. A pair of pivot arms, one being unthreaded 100, the other being internally threaded 101, each have pin ends 102 and 104 mounted in a hole of each bracket. A bolt 106 passes through unthreaded pivot arm 100 and threadedly engages threaded pivot arm 101. Arc plate 94 has a slot 108 in each opposite edge thereof. Side bar portions 110 of arc plate 92 each have a tongue 112 slidably mounted in each slot. Four holes, three of which are shown at 114, 116, and 118 are provided, two in each arc plate for receiving bolts to secure the arc plates to the sleeve. By rotating bolt 106, the arc plates are moved so as to press the ends of the sleeve toward each other until the holes in the sleeve are aligned with those in the reel segments. Shoulder bolts are then inserted in the sleeve to attach it to the reel. After attaching the sleeve to the reel the lifting strap is removed from the sleeve.

I claim:

1. A sleeve for installation onto an expandable and collapsible segmented reel having a gripper bar mounted in an opening of one of the segments for securing one end of a metal strip therein, said sleeve comprising:

a cylindrically-shaped piece of flexible elastomeric material adapted to be wrapped around the outer periphery of the reel, said cylindrically-shaped piece of flexible elastomeric material having opposed ends with edges extending longitudinally to form an axial opening in the sleeve, said ends being adapted to fit mateably with opposed edges of the opening between the gripper bar and the segment in which the gripper bar is mounted, said opposed ends of the cylindrically-shaped piece of flexible elastomeric material having means for providing sufficient stiffness in the sleeve adjacent the opening between the gripper bar and the segment to minimize a flat spot in a coil strip wound on to the reel, said cylindrically-shaped piece of flexible elastomeric material having means on an inner surface adapted to abut the outer periphery of the reel for permitting sufficient expansion of the flexible elastomeric material when the segmented reel is moved from the collapsed to the expanded position that the segment housing the gripper bar is not pulled apart and a widened gap is not formed between the gripper bar and said segment.

2. The sleeve of claim 1 wherein the cylindrically-shaped piece of flexible elastomeric material has a plurality of holes therethrough for receiving means for attaching the sleeve to the reel.

3. The sleeve of claim 1 wherein the means for providing sufficient stiffness in the sleeve comprises metal inserts mounted within the opposed ends thereof.

4. The sleeve of claim 1 wherein the means for permitting sufficient expansion of the flexible elastomeric material comprises a plurality of spaced slits on said inner surface thereof, said slits extending in a transverse direction of the cylindrically-shaped piece of elastomeric material.

5. The sleeve of claim 3 wherein the metal inserts each have a surface forming the inner and outer surfaces and edge faces of the sleeve at the ends adjacent to the opening between the gripper bar and the segment housing said gripper bar.

6. The sleeve of claim 5 wherein the metal inserts have a plurality of holes therethrough for receiving means for attaching the sleeve to the reel.

* * * * *